US006829857B1

(12) United States Patent
Houtsma

(10) Patent No.: US 6,829,857 B1
(45) Date of Patent: Dec. 14, 2004

(54) SMALL ARMS WEAPON BIPOD

(75) Inventor: Gary J. Houtsma, Denville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/708,409

(22) Filed: Mar. 1, 2004

(51) Int. Cl.[7] ..... F41A 29/00
(52) U.S. Cl. ..... 42/94; 89/37.04; 248/532
(58) Field of Search ..... 42/94; 89/37.04, 89/37.03, 37.05; 248/532

(56) References Cited

U.S. PATENT DOCUMENTS 1,382,409 A * 6/1921 Butler ..... 42/94
1,524,973 A * 2/1925 Hazelton ..... 42/94
1,618,966 A * 2/1927 Bull ..... 42/94
2,932,481 A * 4/1960 Breer et al. ..... 248/354.6
3,963,207 A * 6/1976 Guasti ..... 248/168
4,351,224 A * 9/1982 Curtis ..... 89/37.04
4,787,290 A * 11/1988 Argon ..... 89/37.05
5,711,103 A * 1/1998 Keng ..... 42/94
5,903,995 A * 5/1999 Brubach ..... 42/94
6,035,572 A * 3/2000 Goode, Jr. ..... 42/94

* cited by examiner

*Primary Examiner*—Jack Keith
*Assistant Examiner*—M. Thomson
(74) *Attorney, Agent, or Firm*—Michael C. Sachs; John F. Moran

(57) ABSTRACT

A bipod has a base attached to the weapon and a pair of legs which extend in a use position from the base downwards and outwards. Each leg includes an inner member having a pointed distal end and a proximal end attached to the base, and an outer member which freely slides relative to the inner member. The outer member includes a foot through which the pointed distal end extends when the outer member is in an retracted position and hence the pointed distal end is in an exposed position. Each leg also includes a holding mechanism which holds the outer member relative to the inner member such that the pointed distal end is located within the outer member adjacent the aperture of the foot when the outer member is in an extended position and hence the pointed distal end is in a withdrawn or protected position.

14 Claims, 4 Drawing Sheets

SMALL ARMS WEAPON BIPOD

FEDERAL RESEARCH STATEMENT

The inventions described herein may be manufactured, used and licensed by or for the U.S. Government for U.S. Government purposes.

BACKGROUND OF INVENTION

When firing small weapons, especially automatic weapons, from a bipod on hard surfaces such as macadam, concrete or ice, the weapon typically becomes unstable and it is hard to control the point of impact of the projectile. This is a problem which is inherent with all known bipods.

In the prior art, rubber pads have been provided on the bottom feet of a bipod. Such soft rubber pads do provide some improved holding on hard surfaces. However, rubber pads wear away with use, and rubber pads are not effective on ice.

Also in the prior art, saw tooth configurations have been provided on the bottom of the bipod feet. Such saw tooth configurations work well on ice, but offer no advantage on hard surfaces. In addition, the saw tooth configured feet of the prior art are always exposed, creating physical hazards to the user and adjacent people when handling (especially carrying) the weapon. Further, when chemical and biological protective suits are required for the gunner, the risk of degrading and or damaging the protective gear with the exposed sharp teeth of the saw tooth configured feet is a major concern.

SUMMARY OF INVENTION

In accordance with the present invention, a bipod for a weapon is provided having a base which is attached to the weapon and a pair of legs which extend in a use position from the base downwards and outwards away from one another relative to a longitudinal axis of the weapon. Each leg includes an inner member having a pointed distal end and a proximal end which is attached to the base, and an outer member which freely slides relative to the inner member. The outer member includes a foot at a distal end thereof having an aperture therein through which the pointed distal end of the inner member extends when the outer member is in an retracted position and hence the pointed distal end is in an exposed position. Each leg also includes a holding mechanism which holds the outer member relative to the inner member such that the pointed distal end is located within the outer member adjacent the aperture of the foot when the outer member is in an extended position and hence the pointed distal end is in a withdrawn (protected) position.

In a preferred embodiment, the base includes a mounting rail located between the legs. In addition, the base also includes an upper portion, a lower portion, and a means for securing the upper portion and the lower portion together about a receiver of the weapon. Further, each the foot is wider than an adjacent portion of the outer member and two adjacent upturned edges. The pointed distal end is most preferably made of hardened steel.

In the preferred embodiment, the holding mechanism allows free movement of the outer member relative to the inner member as the outer member moves from the retracted position to the extended position. Thus, the pointed distal end is easily changed between the exposed position and the withdrawn position simply by pulling on the outer member. Preferably, the holding mechanism is automatically engaged as the outer member is moved from the retracted position to the extended position and hence the pointed distal end is changed from the exposed position to the withdrawn position. This is conveniently accomplished wherein the holding mechanism includes a spring loaded latch extending from an inside surface of the outer member of each the leg.

Also in the preferred embodiment, the base includes a mounting means for mounting each leg thereto for pivoted movement to a position parallel and adjacent to the longitudinal axis of the weapon. In addition, the mounting means mounts each leg for movement either forwards and rearwards from the use position.

It is an advantage of the present invention that automatic weapons can be fired from a bipod on hard surfaces, such as macadam, concrete or ice, with stability and control.

It is also an advantage of the present invention that the pointed end is retracted during non-use periods so that the pointed end is not a danger to the user or to others.

It is a further advantage of the present invention that the pointed end is moved to the use/extended position only by a positive movement of the user.

It is yet another advantage of the present invention that the bipod is fixed to the receiver of the weapon in a manner which does not interfere with access to an accessory rail of the weapon.

It is still another advantage of the present invention that the bipod legs fold forward and out of the way during non-use, so that if the pointed distal end is not in the withdrawn position it also points away from the user.

It is still another advantage of the present invention that the bipod can be easily taken apart and cleaned.

Other features and advantages of the present invention are stated in or apparent from detailed descriptions of presently preferred embodiments of the invention found hereinbelow.

DETAILED DESCRIPTION

Figure 1:
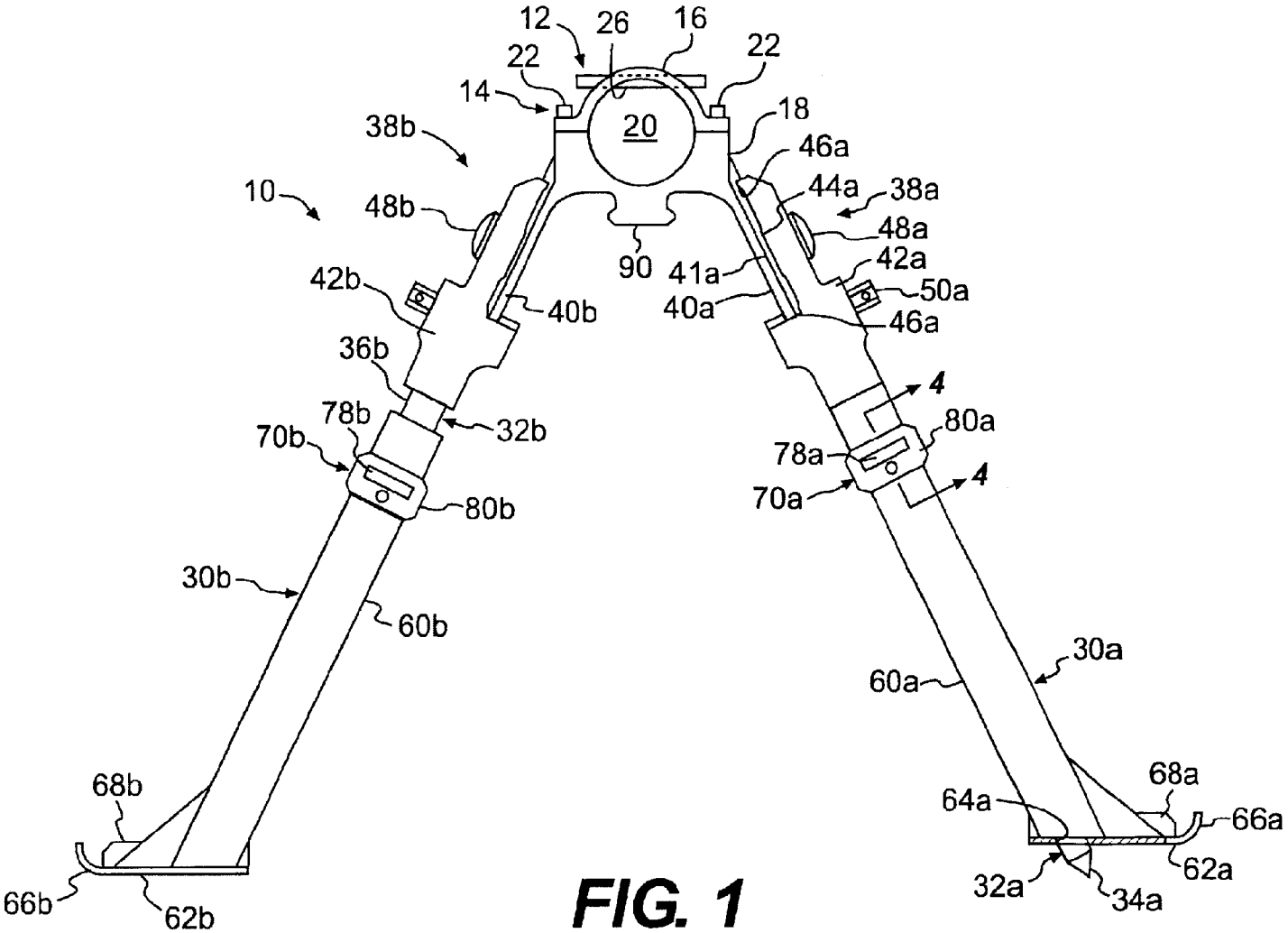
FIG. 1 is a front elevation view of a bipod system in accordance with the present invention.
Figure 3:
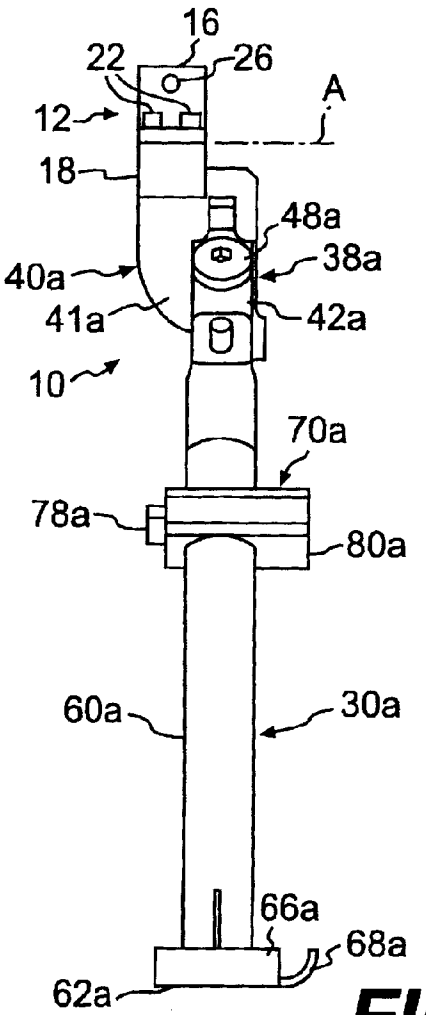
FIG. 3 is a right side elevation view of the bipod system of FIG. 1.
Figure 2:
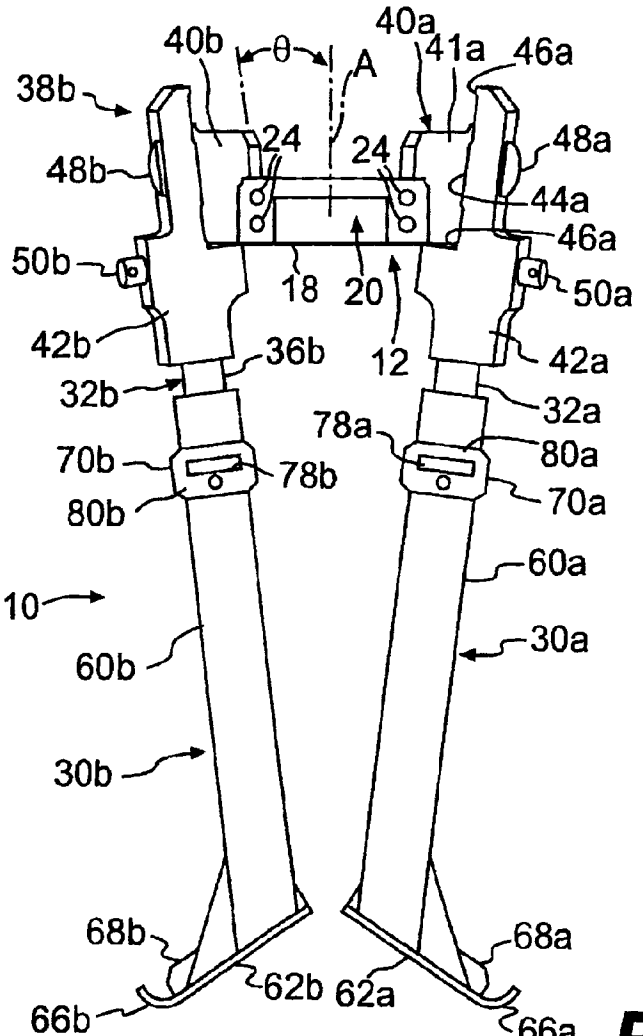
FIG. 2 is a top elevational view of the bipod system of FIG. 1 with a part of the securing means removed and the legs in a stowed position.
Figure 5:
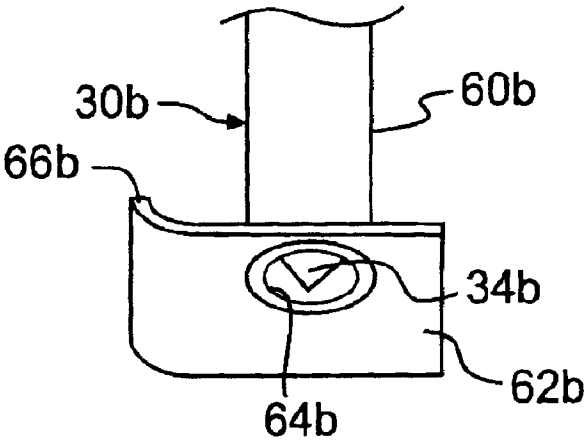
FIG. 5 is a bottom and front perspective view of a foot of the bipod system of FIG. 1.

With reference now to the drawings in which like numerals represent like elements throughout the views, a bipod 10 in accordance with the present invention is depicted in FIG. 1 in an extended or use position and in FIG. 2 in a folded or stored position. Bipod 10 includes a base 12 which is attached by a securing means 14 to a suitable receiver (not shown) of the weapon having an axis A which is generally parallel to the barrel of the weapon. Preferably, the receiver is a reduced collar portion of the gas chamber of an automatic weapon, but some other suitable element can instead or alternately be provided on the weapon as necessary or desired.

Securing means 14 is provided by forming base 12 of an upper portion 16 and a lower portion 18 which fit together to define therebetween a hole 20 through which the reduced collar portion of the receiver is rotatably received. Securing means 14 allows the weapon to be rotated relative to bipod 10 in order to keep the sights of the weapon vertically oriented and hence not canted when the surface that bipod 10 rests on is not (as is typical) horizontal. Of course, the reduced collar portion keeps securing means 14 from moving along the reduced collar portion (horizontally along axis A) even while rotation is allowed. During non-use of the weapon when it is anticipated that bipod 10 will be in a stored position for some time, a pin 26 is removably received in upper part 16 so that a portion of pin 26 extending through hole 20 is also received in a matching groove provided in an upper part of the reduced collar portion. Thus, when pin 26 is in place during non-use of the weapon, base 12 of bipod 10 is oriented in a position directly beneath the gas chamber and bipod 10 does not rotate (is made immovable) relative to the collar portion.

Upper portion 16 is attached to lower portion 18 with bolts 22 which pass through bores in upper portion 16 and which are threadably received in threaded bores 24 in lower portion 18 as shown. Thus, securing means 14 is used to removably secure base 12 to the receiver at the position of the reduced collar by tightening of bolts 22. While hole 20 has been depicted as circular, it will be appreciated that other shapes may be used as desired and required, so long as the securing to the receiver is suitably effected. For example, hole 20 could instead be polygonal shaped (especially octagonal), to provide discrete multiple surfaces which engage a round receiver. In addition, depending on which direction the receiver extends through hole 20, the folded position can extend away (preferred) or towards a stock of the weapon.

Attached to base 12 is a pair of legs 30*a* and 30*b* which form the two vertical supports of bipod 10. Legs 30*a* and 30*b* extend in the use position shown in FIG. 1 downwards and outwards from base 12 and away from one another relative to the longitudinal axis A of the weapon. Each leg 30*a* and 30*b* is a mirror image of the other, so only the associated elements of leg 30*a* will be described in detail, and for convenience such elements will use the "a" after the number even where a corresponding element of the other leg 30*b* is not identified.

Figure 6:
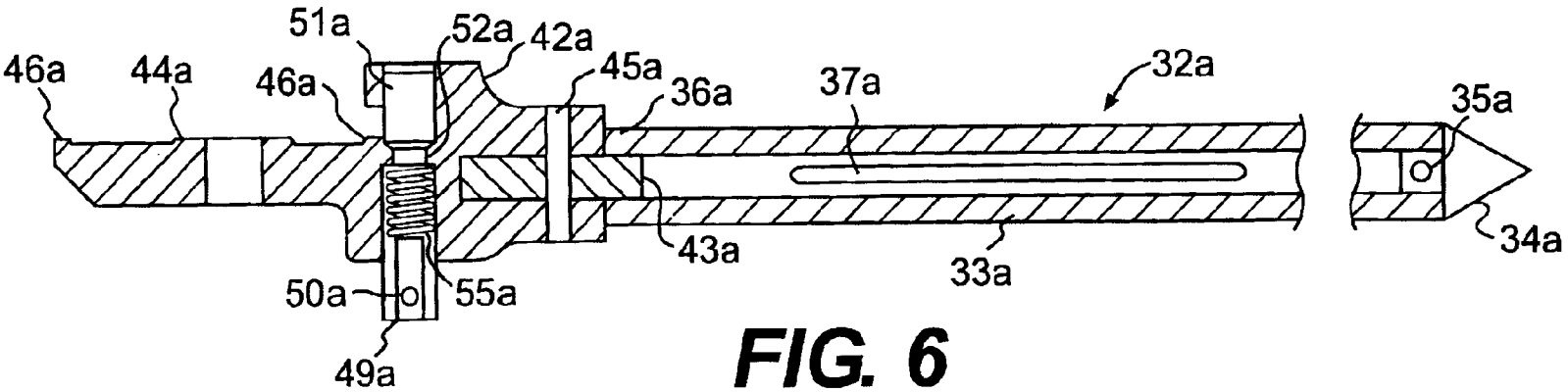
FIG. 6 is a cross sectional side view of an inner member of the present invention.

As shown, leg 30*a* includes an inner member 32*a* having a pointed distal end 34*a* and a proximal end 36*a* which is attached to base 12. At least pointed distal end 36*a* of inner member 32*a* is made of a hardened steel or the like, or covered with a hard coating to achieve a similarly hard outside surface resistant to wear and dulling of the point thereof. Preferably, as shown in FIG. 6, inner member 32*a* includes a tube 33*a* to which a discrete pointed distal end 34*a* is attached by use of a spring pin 35*a* removably passing through tube 33*a* and an adjacent reduced portion of pointed distal end 34*a* closely received in tube 33*a*. It will be noted that tube 33*a* includes a longitudinal slot 37*a* therein, whose purpose will be explained subsequently.

The attachment of proximal end 36*a* to base 12 is made by a mounting means 38*a* by which leg 30*a* is pivotally mounted relative to lower portion 18*a* (and hence pivotally displaceable towards and away from weapon axis A). In particular, mounting means 38*a* includes a flange 40*a* which is integral with lower portion. Flange 40*a* has a pivoting surface 41*a* oriented at an angle Θ with respect to axis A, which in this preferred embodiment is about 6°. Pivotally attached to flange 40*a* is head 42*a* having a main surface 44*a* and small side surfaces 46*a* which freely ride along pivoting surface 41*a*. As shown in FIG. 6, proximal end 36*a* of inner member 32*a* is attached to head 42*a* by use of a dowel 43*a* received in a close fitting manner inside both proximal end 36*a* and an adjacent bore in head 42*a*. Dowel 43*a* is held in position by use of a removable spring pin 45*a* which passes through tube 33*a* and dowel 43*a*.

Figure 8:
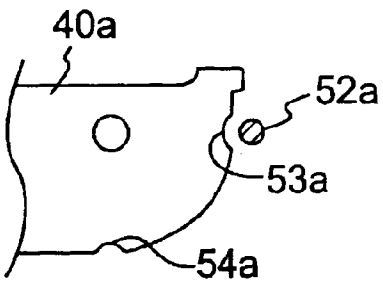
FIGS. 7 and 8 are schematic side views of portions of a flange with a locking member respectively at a locked position and an unlocked position.
Figure 7:
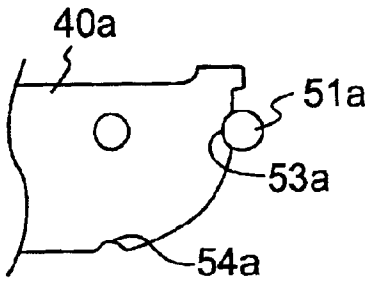

Pivotally holding head 42*a* to flange 40*a* is a hold-down member 48*a*. Hold-down member 48*a* is used hold head 42*a* in place while allow pivoting of head 42*a* between the use position of leg 30*a* as depicted in FIG. 1 and the storage position as depicted in FIG. 2. As shown best in FIG. 6, a locking means 49*a* is used to lock leg 30*a* in either the use or storage position. Locking means 49*a* includes a spring mounted pin 50*a* having a detent 51*a* and a reduced mid-section 52*a*. Detent 51*a* is positioned to be biased by a spring 55*a* into either of notches 53*a* or 54*a* provided in the adjacent perimeter of flange 40*a* as shown in FIGS. 7 and 8, with notches 53*a* and 54*a* corresponding to the use and storage positions of leg 30*a*. It will be appreciated that when pin 50*a* is moved against the force of spring 55*a* to release detent 51*a* from the associated notch 53*a* or 54*a* (as by a temporary pushing on pin 50*a* or by a forceful jerk on leg 30*a* in the desired pivoting direction), the adjacent end of detent 51*a* and reduced mid-section 52*a* are positioned to ride freely along the adjacent cent perimeter of flange 40*a* until detent 51*a* is again spring biased into one of notches 53*a* or 54*a*. Thus, locking means 49*a* makes it easy to pivot leg 30*a* by pulling on leg 30*a* between the forward folded position as depicted in FIG. 2 or the use position shown in FIG. 1).

Mounted for free sliding movement on inner member 32*a* is an outer member 60*a* which is conveniently made of lightweight aluminum for easier movement, while the remainder of bipod 10 is made of a durable steel. Outer member 60*a* only slides freely on inner member 32*a* within the limits determined the ends of slot 37*a* of tube 33*a* as a set screw 61*a* is threadably received in outer member 60*a* extends into slot 37*a*. Outer member 60*a* includes a foot 62*a* at the distal end thereof having an aperture 64*a* (shown in FIG. 1 where a portion of foot 62*a* has been broken away) through which pointed distal end 34*a* of inner member 32*a* extends when outer member 60*a* is in a retracted position as shown in FIG. 1 so that pointed distal end 34*a* is in an exposed position. Foot 62*a* extends about outer member 60*a* in a plane which is parallel to the ground when bipod 10 is in a use position, and foot 62*a* also includes two adjacent upturned edges 66*a* and 68*a* at the associated extremities thereof. In order to hold outer member 60*a* relative to inner member 32*a*, a holding mechanism 70*a* is provided. Holding mechanism 70*a* is used to maintain pointed distal end 34*a* within outer member 60*a* and adjacent aperture 64*a* when outer member 60*a* is in an extended (away from base 12) position so that pointed distal end 34*a* is thus in a withdrawn position where pointed end 34*a* cannot accidentally engage anything or anyone.

Figure 4:
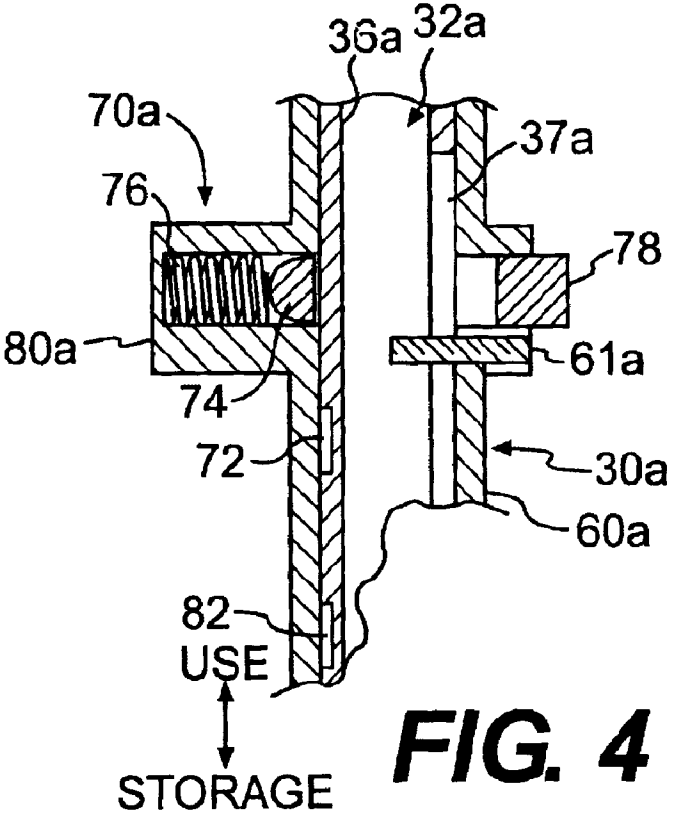
FIG. 4 is a cross-sectional view of the holding mechanism of FIG. 1 where the outer member is in the retracted position.

Preferably, holding mechanism 70*a* allows free movement of outer member 60*a* relative to inner member 32*a* as outer member 60*a* is moved from the retracted position to the extended position simply by pulling on outer member 60*a*. In this manner, outer member 60*a* is easily and quickly movable to the extended position, especially as leg 30*a* is also moved by the user from the use position to the storage position. To accomplish this, holding mechanism 70*a* includes a first notch 72 provided on the outer surface of inner member 32*a* as shown in FIG. 4. Located adjacent notch 72, but displaced upwards relatively thereto in the non-engaged position of FIG. 4, is a detent 74 which is resiliently biased by a spring 76 towards a position where detent 74 will engage notch 72. Detent 74 is integral with a button 78*a* (as by forming essentially a rectangular latch) located on the opposite side of inner member 32*a* from notch 72. It will thus be appreciated that spring 76, detent 74 and button 78*a* are located in a housing 80*a* of outer member 60*a* with button 78*a* extending slightly from housing 80*a* in order to be depressed by a user and thereby to release detent 74 from notch 72 when desired. Located below notch 72 is one or more second notches 82 (only one of which is shown).

In operation as associated with pointed distal end 34*a*, holding mechanism 70*a* functions in the following manner. When detent 74*a* is located in notch 72*a*, outer member 60*a* is held in the extended position where pointed distal end 34*a* is withdrawn inside of foot 62*a*. In this extended position, pointed distal end can not injure anything or anyone, and as outer member 60*a* is securely held in place, pointed distal end will not move from this withdrawn position except by purposeful action of the user. While outer member 60*a* is in this extended position, leg 30*a* may be in either the stored position of FIG. 2 (or even oppositely directed along the receiver axis A if desired by reversal of the front-back orientation of securing means 14), or in the use position of FIG. 1 where foot 62*a* engages the ground. When it is desired to use pointed distal end 34*a* to engage a hard surface or otherwise be exposed, button 78*a* is depressed by the user (after bringing leg 30*a* down, or as leg 30*a* is brought down from the stored position of FIG. 2 if needed) as the user also pushes up on outer member 60*a* to move outer member 60*a* from the extended position (hiding pointed distal end 34*a*) to the retracted position (exposing pointed distal end 34*a*). Alternatively, with foot 62*a* (and foot 62*b*) resting on the ground and supporting the weight of the weapon, button 78*a* can be depressed to release outer member 60*a* from the extended position so that the weight of the weapon will move outer member up towards the retracted position sufficiently enough to expose pointed distal end 34*a* for engagement with the ground.

Once it is no longer desired to have pointed distal end 34*a* exposed, the user simply pulls downward (or outward from weapon axis A) on outer member 60*a* until detent 74 automatically engages notch 72, due to the resilient force of spring 76. This movement thus locks outer member 60*a* in the extended position until button 78*a* is again depressed by the user. It will be noted that the pulling on outer member 60*a* may be simply and somewhat naturally (or unavoidably) accomplished as leg 30*a* is moved from the use to the stored position, facilitating the desired positioning of pointed distal end 34*a* in the withdrawn position quickly and easily.

It will be appreciated that if it is desired to have outer member 60*a* extend beyond the extended position described, to provide bipod 10 with a greater height, that button 78*a* can also be depressed and outer member 60*a* pulled downward until detent 74 engages second notch 82; or if a plurality of notches 82 are provided (where notches 82 are provided, of course, within the limits of movement determined by set screw 61*a* in slot 37*a*), to the desired notch 82. Subsequently, if it is thereafter desired to have pointed distal end 34*a* in the exposed position, button 78 must be depressed until detent 74 passes by first notch 72.

In this preferred embodiment, base 12 is also provided with a standard (MIL-STD-1913) accessory mounting rail 90 beneath lower portion 18 for convenience, which rail 90 will be additional to any standard accessory mounting rail provided on the weapon itself and which it will be noted is not interfered with by bipod 10.

While various preferred embodiments of the invention have been described above, other equivalent mechanical operators can be employed. For example, a number of different holding mechanisms, including a spring biased pin such as pin 50*a*, could be used. Similarly, various mounting means besides mounting means 38*a* could be used to move leg 30*a* from a locked use position to a locked storage position. Further, while inner member 32*a* and outer member 60*a* have been depicted and described as being tubes, these members could also be angle, flat, or otherwise shaped as desired.

Thus, while the present invention has been described with respect to exemplary embodiments thereof, it will be understood by those of ordinary skill in the art that other variations and modifications can be effected within the scope and spirit of the invention.

I claim:

1. A bipod for a weapon comprising:

a base which is attached to the weapon;

a pair of legs which extend in a use position from said base downwards and outwards away from one another relative to a longitudinal axis of the weapon, each said leg including an inner member having a pointed distal end and a proximal end which is attached to said base, an outer member which freely slides relative to said inner member, said outer member including a foot at a distal end thereof having an aperture therein through which said pointed distal end of said inner member extends when said outer member is in an retracted position and hence said pointed distal end is in an exposed position, and a holding mechanism which holds said outer member relative to said inner member such that said pointed distal end is located within said outer member adjacent said aperture of said foot when said outer member is in an extended position and hence said pointed distal end is in a withdrawn position.

2. A bipod as claimed in claim 1, wherein said base includes a mounting rail located between said legs.

3. A bipod as claimed in claim 1, wherein said base includes an upper portion, a lower portion, and a means for securing said upper portion and said lower portion together about a receiver of the weapon.

4. A bipod as claimed in claim 1, wherein said foot of each said leg is wider than an adjacent portion of said outer member and includes two adjacent upturned edges.

5. A bipod as claimed in claim 1, wherein each said pointed distal end of each said leg is made of hardened steel.

6. A bipod as claimed in claim 1, wherein said holding mechanism of each said leg allows free movement of said outer member relative to said inner member as said outer member moves from the retracted position to the extended position such that said pointed distal end is easily changed between the exposed position to the withdrawn position by pulling on said outer member.

7. A bipod as claimed in claim 6, wherein said holding mechanism of each said leg is automatically engaged as said outer member is moved from the retracted position to the extended position and hence said pointed distal end is changed from the exposed position to the withdrawn position.

8. A bipod as claimed in claim 7, wherein said holding mechanism of each said leg includes a spring loaded latch extending from an inside surface of said outer member of each said leg.

9. A bipod as claimed in claim 1, wherein said base includes a mounting means for mounting each said leg thereto for pivoted movement to a position parallel and adjacent to the longitudinal axis of the weapon.

10. A bipod as claimed in claim 9, wherein said mounting means of each said leg mounts each said leg for movement either forwards or rearwards from the use position.

11. A bipod as claimed in claim 2, wherein said base includes an upper portion, a lower portion, and a means for securing said upper portion and said lower portion together about a receiver of the weapon.

12. A bipod as claimed in claim 11, wherein said holding mechanism of each said leg allows free movement of said outer member relative to said inner member as said outer member moves from the retracted position to the extended position such that said pointed distal end of each said leg is easily changed between the exposed position to the withdrawn position by pulling on said outer member.

13. A bipod as claimed in claim 12, wherein said holding mechanism of each said leg is automatically engaged as said outer member is moved from the retracted position to the extended position and hence said pointed distal end of each said leg is changed from the exposed position to the withdrawn position.

14. A bipod as claimed in claim 1, wherein said base includes a mounting means for mounting each said leg thereto for pivoted movement to a position parallel and adjacent to the longitudinal axis of the weapon.

* * * * *